US006502707B1

(12) United States Patent
Sullivan

(10) Patent No.: US 6,502,707 B1
(45) Date of Patent: Jan. 7, 2003

(54) SHOE CAROUSEL DEVICE

(76) Inventor: Andrew Sullivan, 108 E. Old State Rd., Sellersville, PA (US) 18960

( * ) Notice: Subject to any disclaimer, the term of this patent is extended or adjusted under 35 U.S.C. 154(b) by 0 days.

(21) Appl. No.: 09/943,810

(22) Filed: Aug. 31, 2001

(51) Int. Cl.[7] ..... A47F 5/02

(52) U.S. Cl. ..... 211/163; 211/36; 211/144; 211/181.1

(58) Field of Search ..... 211/163, 34, 36–37, 211/78, 166, 181.1, 205, 196, 144, 187, 188, 133.5, 131.1, 133.4; 108/103, 239

(56) References Cited

U.S. PATENT DOCUMENTS

| | | | | | |
|---|---|---|---|---|---|
| 1,961,870 | A | * | 6/1934 | Weston | 211/34 |
| 2,071,290 | A | * | 2/1937 | Scriba | 211/181.1 |
| 2,883,063 | A | * | 4/1959 | Baren | 211/78 |
| 2,973,867 | A | * | 3/1961 | Cohen | 211/37 |
| 3,061,108 | A | * | 10/1962 | Duggan | 211/37 |
| 3,266,634 | A | * | 8/1966 | Tintary | 211/131.1 |
| 3,452,880 | A | * | 7/1969 | Kovacik et al. | 211/77 |
| 3,833,128 | A | * | 9/1974 | Sumner | 211/131.1 |
| 3,963,126 | A | * | 6/1976 | Taub | 211/131.1 |
| 4,036,367 | A | * | 7/1977 | Stambaugh et al. | 211/37 |
| 4,056,194 | A | * | 11/1977 | Radek | 211/131.1 |
| 4,736,856 | A | * | 4/1988 | Alneng et al. | 211/131.1 |
| 4,858,772 | A | * | 8/1989 | Phillipson | 211/36 |
| 5,050,746 | A | * | 9/1991 | Frankel | 211/34 |
| 5,562,216 | A | * | 10/1996 | Falconio | 211/33 |
| 5,984,114 | A | * | 11/1999 | Frankel | 211/34 |

* cited by examiner

*Primary Examiner*—Daniel P. Stodola
*Assistant Examiner*—Jennifer E. Novosad
(74) *Attorney, Agent, or Firm*—Armand M. Vozzo, Jr.

(57) ABSTRACT

A shoe carousel particularly suitable for use in closets and other confined areas comprises a series of rotatable wire rack members spaced apart and coaxially mounted upon a central shaft so that each respective wire rack member rotates independently at separate locations along the shaft. The shaft is adapted to be stationed upon a floor surface in a substantially vertical position supported within a base stand and may be adjustable in its length to provide floor to ceiling engagement when necessary. The wire rack members are separately mounted and supported upon the shaft in substantially horizontal planes and are specially formed to hold and display a variety of shoes upon the surface of the rack member. Each rack member is constructed from a plurality of radial spokes centrally connected to a hub member at inner ends of the spokes. The radial spokes are each further formed having a downwardly inclined segment to provide each rack member with a conically-shaped framework with the outermost ends of the radial spokes each being formed at an acute angle relative to the inclined segment that provides a substantially vertical rim raised around the bottom of each rack member. A series of concentric wire rings having progressively increasing diameters are attached to and over the radial spokes to provide an inclined support surface for storing a variety of shoes retained in place and during rotation by the raised rim.

12 Claims, 7 Drawing Sheets

SHOE CAROUSEL DEVICE

BACKGROUND OF THE INVENTION

The present invention relates to rotatable storage racks used to support articles, such as shoes, and more particularly to an improved shoe carousel device for supporting a multitude of shoes in a confined space with easy and ready access being provided to any of those shoes selected by the user.

Household storage space for clothing and accessory articles is generally found to be insufficient in present homes and apartments, with closets being typically provided with a standard amount of space for hanging clothes and only a minimal amount of shelved or rack space for accessory articles, especially shoes. When combined with the often found surplus of shoes accumulated today, particularly by women, this condition of insufficient storage space results in disorganized and inefficient piling of shoes within already crowded closet spaces or in the stacking of the shoes in boxes in or around the closet area on otherwise usable floor space makes shoe selection difficult and tends to cause those boxed shoes to be disregarded by the user.

There have been numerous shoe racks and other footwear support devices that have been designed and developed in the prior art for use in closets and other confined spaces. Generally designed to make more efficient use of closet areas for shoe storage, these prior art shoe racks have been typically multi-tiered and rotatable about a vertical shaft in the nature of a "lazy Susan" so that shoes may be stored on different shelf levels and made accessible to the user by rotating the whole rack. While some of these "lazy Susan" types of shoe racks appear to be portable, most have required a fixed installation of the shaft between fixed upper and lower horizontal surfaces with bearing members at the top and bottom of the shaft to allow the whole rack to revolve in place when heavily loaded with shoes. While being effective in the greater use of closet space and in providing accessibility to a larger number of shoes, these whole turning racks have presented difficulties in their installation and their adaptability for use in a variety of confined spaces.

Other prior art shoe racks have been free standing and thus portable in nature, generally having forms of wire racks rotatably mounted at different vertical levels on a central shaft to store and access the shoes stored thereon upon rotation. While those free standing wire shoe racks have proven effective in supporting and handling a limited number of shoes, the stability and free turning characteristics of their structure has been reduced under the weight of a large number of shoes and as a result, their effective storage capacity is limited. Furthermore, the wire rack formations found in the prior art, both in the free-standing and installed types of rotatable shoe racks, have tended to work well in supporting high-heeled women's shoes but have not been quite suitable for lesser heeled footwear.

As such, it can be appreciated that there continues to be a need for a new and improved rotary shoe rack device that addresses the limitations of the prior art in strength of construction, ease of use and deployment, and suitability for handling a larger number and wider variety of shoes.

SUMMARY OF THE INVENTION

Accordingly, it is general purpose and object of the present invention to provide an improved rotatable shoe rack device that makes efficient use of storage space, such as closets and the like, and better handles a full capacity and wider variety of shoes than those shoe rack constructions heretofore developed.

Another object of the present invention is to provide an improved shoe rack device that is lightweight and portable yet provides increased stability in storing and handling of a large number of shoes.

Still another object of the present invention is to provide a rotatable shoe rack that is multi-level in its construction with separate levels being adjustable and independently rotatable to provide greater viewability and accessibility to the shoes stored thereon.

A further object of the present invention is to provide an improved rotatable shoe rack device that is normally free standing and able to be moved easily yet is adaptable for fixed installation at a particular location.

A still further object of the present invention is to provide a rotatable shoe rack that is reasonably inexpensive to manufacture, easy to assemble and deploy, and reliable in its operation.

Briefly, these and other objects of the present invention are accomplished by a shoe carousel device particularly suitable for use in closets and other confined areas and comprising a series of rotatable wire rack members spaced apart and coaxially mounted upon a central shaft so that each respective wire rack member rotates independently at separate locations along the shaft. The shaft is adapted to be stationed upon a floor surface in a substantially vertical position supported within a base stand and may be adjustable in its length to provide floor to ceiling engagement when necessary. The wire rack members are separately mounted and supported upon the shaft in substantially horizontal planes and are specially formed to hold and display a variety of shoes upon the surface of the rack member. Each rack member is constructed from a plurality of radial spokes centrally connected to a hub member at inner ends of the spokes. The radial spokes are each further formed having a downwardly inclined segment to provide each rack member with a conical configuration, the outermost ends of the radial spokes each being formed at an acute angle relative to the inclined segment that provides a substantially vertical rim raised around the bottom of each rack member. A series of concentric wire rings having progressively increasing diameters are attached to and over the radial spokes to provide an inclined support surface for storing a variety of shoes retained in place and during rotation by the raised rim.

For a better understanding of these and other aspects of the present invention, reference should be made to the following detailed description taken in conjunction with the accompanying drawings in which like reference numerals and characters designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DESCRIPTION OF THE PREFERRED EMBODIMENT

Figure 1:
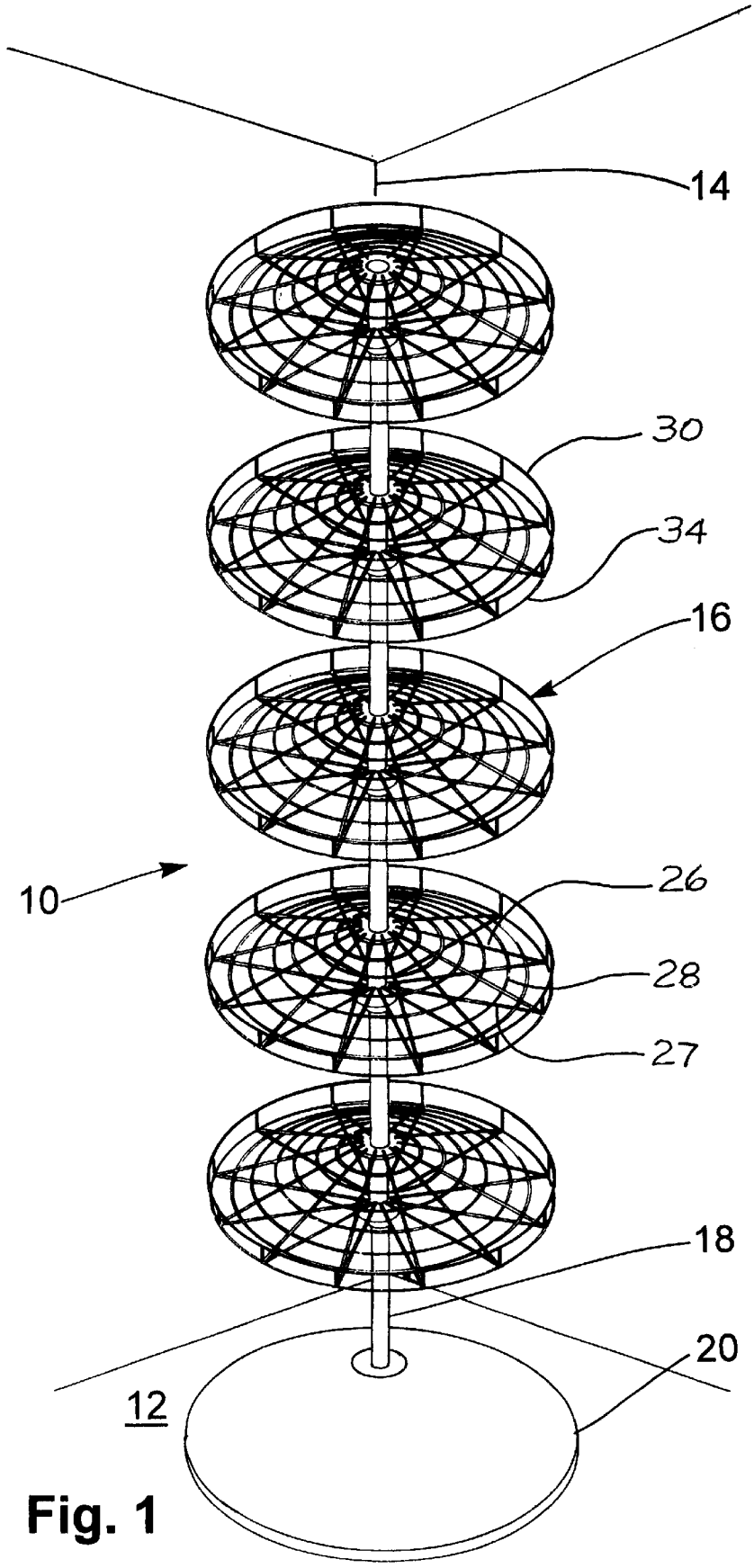
FIG. 1 is a perspective view of a corner space containing a shoe carousel device in accordance with the present invention.

Referring now to the drawings and initially to the illustration of FIG. 1, a shoe carousel device, made in accordance with the present invention and generally designated 10, is shown positioned upon a floor surface 12 in a comer 14 of a room or closed space, such as a closet. The shoe carousel device 10 comprises a plurality of circular wire rack members 16 coaxially mounted for rotation and spaced apart along a central shaft 18 that is supported in a fixed vertical attitude within a base stand 20. Each of the wire rack members 16 is similarly constructed having a conical configuration, best viewed in FIGS. 2–4, with substantially the same dimensions in slope and outer diameter. While the slope and outer diameter of the wire rack members 16 may vary depending on the type of shoes to be stored thereon and the size of the closet or other space intended for use, the outer diameter is typically maintained at less than twenty-four inches to permit the shoe carousel device 10 to fit into most standard closet spaces with the typical vertical-to-horizontal slope approximating ⅓ to accommodate most standard shoe sizes.

Figure 2:
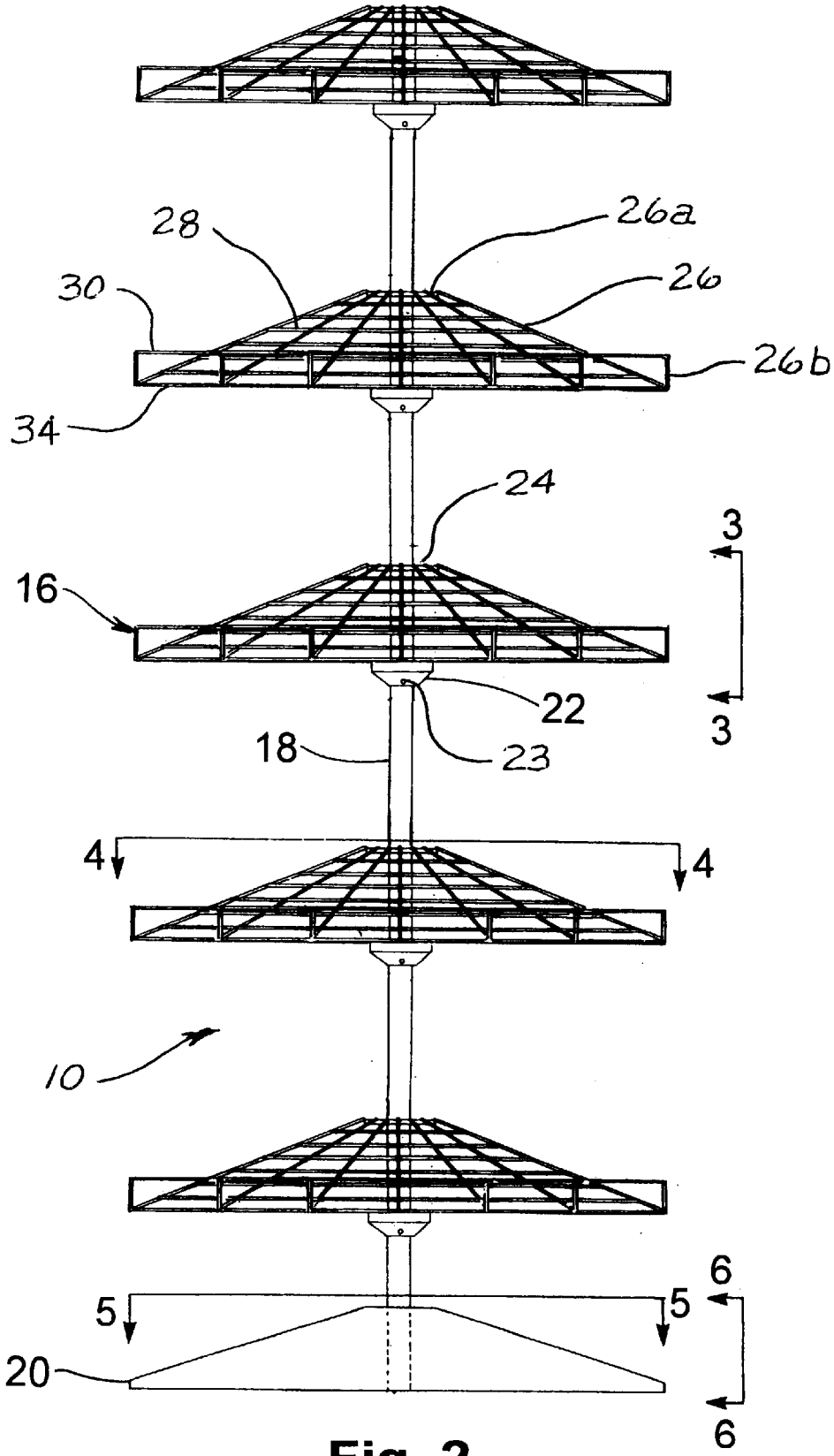
FIG. 2 is a side elevation of the shoe carousel device shown in FIG. 1.

Referring now to FIG. 2 in conjunction with FIG. 1, the wire rack members 16 are coaxially mounted upon the central shaft 18 with a hub member 24, described in greater detail hereinbelow, being centrally disposed within each rack member and formed to slide along the central shaft. Each wire rack member 16 is disposed in a substantially horizontal attitude at separate positions along the shaft 18, each rack member being positioned to rest upon a respective one of a plurality of stop sleeves 22 releasably secured to the shaft. The stop sleeve 22, the number of which corresponds to the number of wire rack members 16, is a rigid cylindrical member formed to fit coaxially over the central shaft and adapted to be locked in place at a selected position along the shaft, typically by means of a set screw 23 or like threaded member that radially engages the shaft through the body of the stop sleeve. The top of each stop sleeve 22 is formed to provide a smooth flat bearing surface upon which each wire rack member 16 may rest and freely turn about the central shaft 18, as described in greater detail below, when manipulated by the user.

Shaft 18 is a rigid longitudinal member cylindrical in form along its entire length. Shaft 18 is preferably made of metal, such as steel or aluminum, and tubular in construction to provide a lightweight assembly for the shoe carousel device 10, but may alternatively be a solid rod-like member, particularly when used in shorter lengths. The length of shaft 18 may vary based upon the specific application of the user and the number of wire rack members 16 to be employed on the shoe carousel device 10. Typically, the length of the central shaft 18 will range from five to six feet in order to accommodate as many as six wire rack members 16 spaced approximately one foot apart. The diameter of the shaft 18 is sized to fit tightly into a central opening in the top of base stand 20, best seen in FIG. 5.

Figure 5:
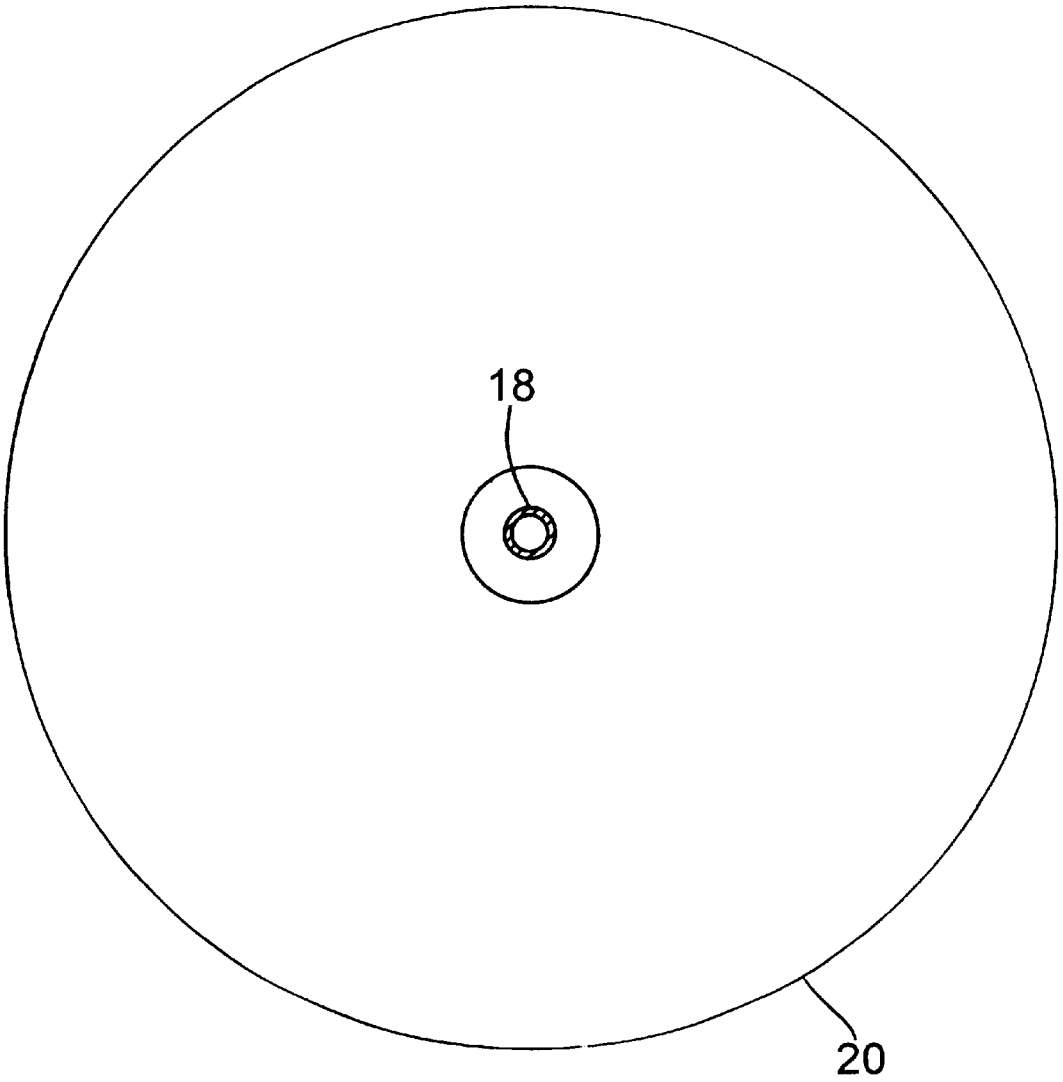
FIG. 5 is a top plan view, partly in section, of the portion of the shoe carousel device taken along the line 5—5 of FIG. 2.
Figure 6:
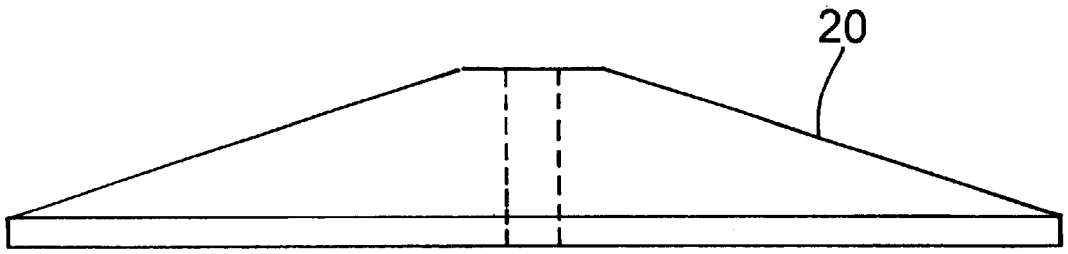
FIG. 6 is a side view in elevation of the base support of the shoe carousel device taken along the line 6—6 of FIG. 2.

Referring further to FIGS. 5 and 6, the base stand 20 is a substantially solid member having a rounded upper surface and a flat bottom surface to provide firm and balanced support to the shoe carousel device 10 both while standing and during rotation of the wire rack members 16. The central opening in the base stand 20 extends vertically through the stand from the top to the bottom surface thereof to tightly engage a length of the lower portion of the shaft 18 and thereby stabilize the shaft in a vertical attitude upon the floor surface 12. It should be noted that the fitted engagement of the shaft 18 with the base stand 20 is sufficient to resist rotation of the shaft while within the stand and to maintain the shaft in an erect position while supporting the wire rack members 16 thereon.

Figure 3:
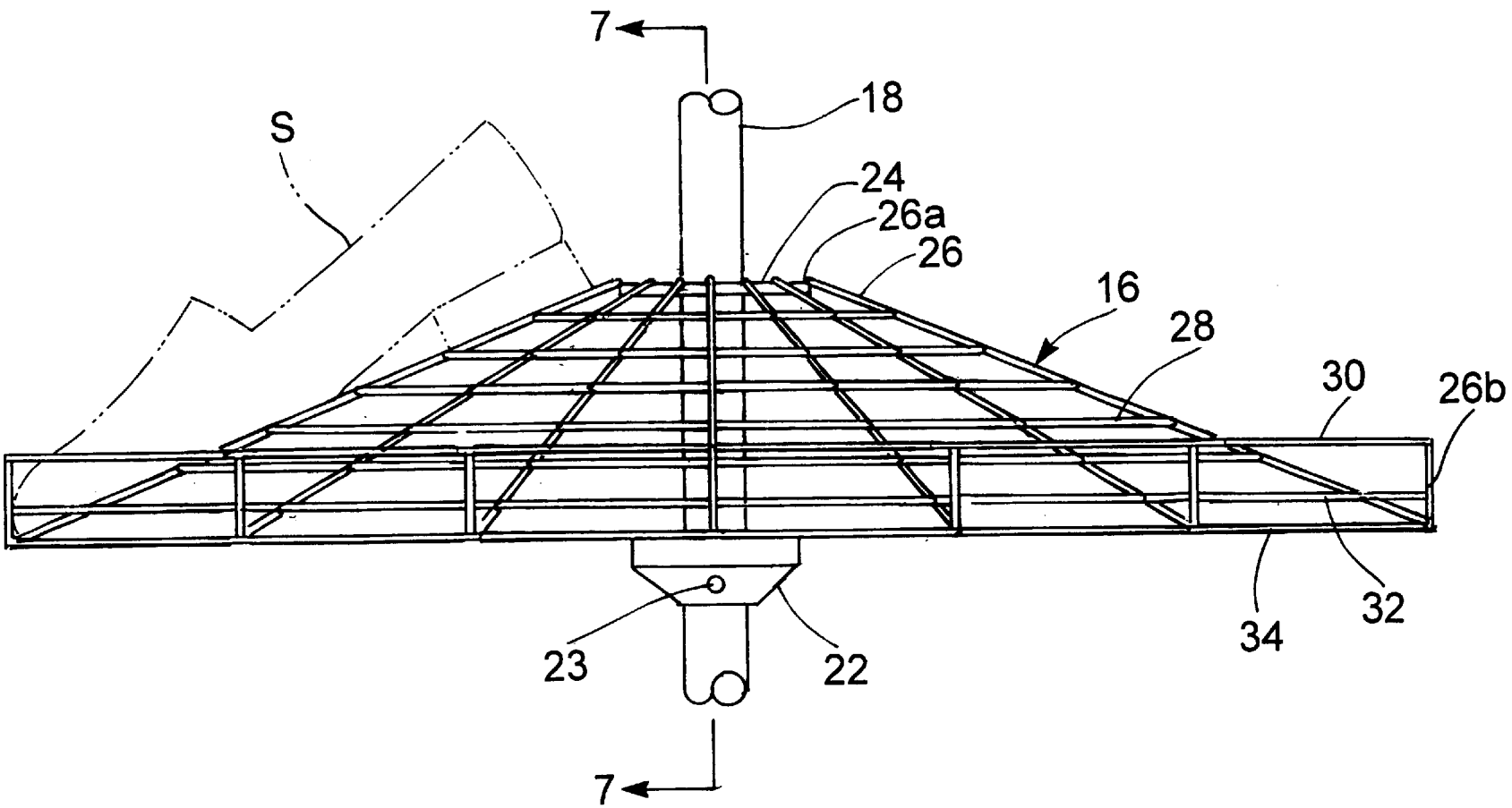
FIG. 3 is a plan view in elevation of a portion of the shoe carousel device taken along line 3—3 of FIG. 2.
Figure 4:
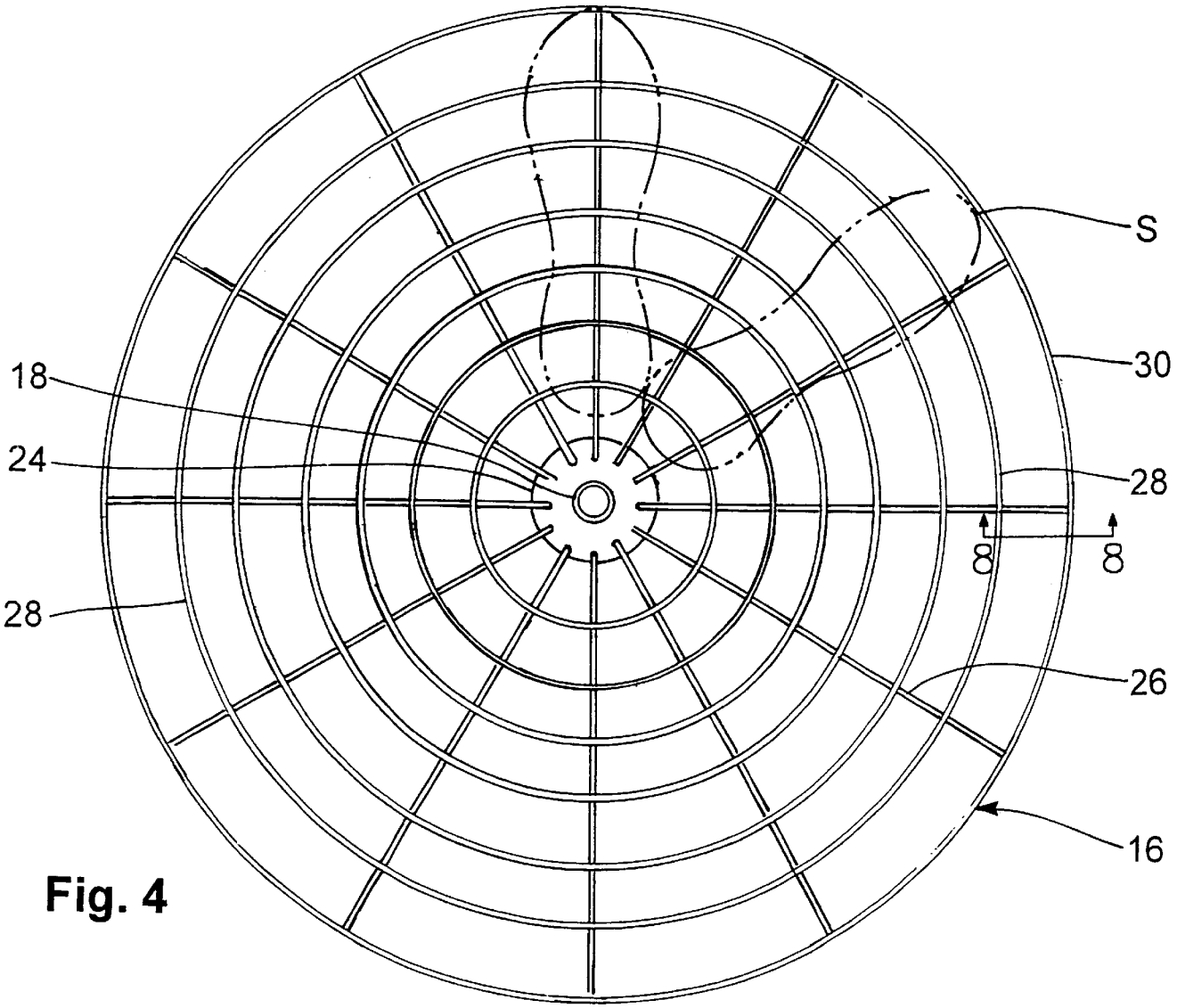
FIG. 4 is a top plan view, partly in section, of the shoe carousel device taken along the line 4—4 shown in FIG. 2.

Referring now to FIGS. 3 and 4 wherein a shoe S is shown in phantom supported in a "toe-down" position upon the present carousel device 10, each wire rack member 16 is constructed about a hub member 24 intended to serve as its central core. Preferably made of a rigid metallic material, such as steel, the hub member 24 has a substantially cylindrical body with an inner diameter sized to fit coaxially upon the shaft 18 and slide freely therealong. The length of the hub member 24 extends axially and substantially through the wire rack member 16 and may vary depending upon the height and slope of the wire rack member specifically intended for use. The upper end of each hub member 24 has a flat washer-like surface with a widened outer diameter that extends beyond that of the cylindrical body of the hub member. This extended washer-like surface, integrally connected to the body of the hub member 24, such as by welding, serves to become the central structure of each wire rack member 16 in support of its wire framework.

Figure 8:
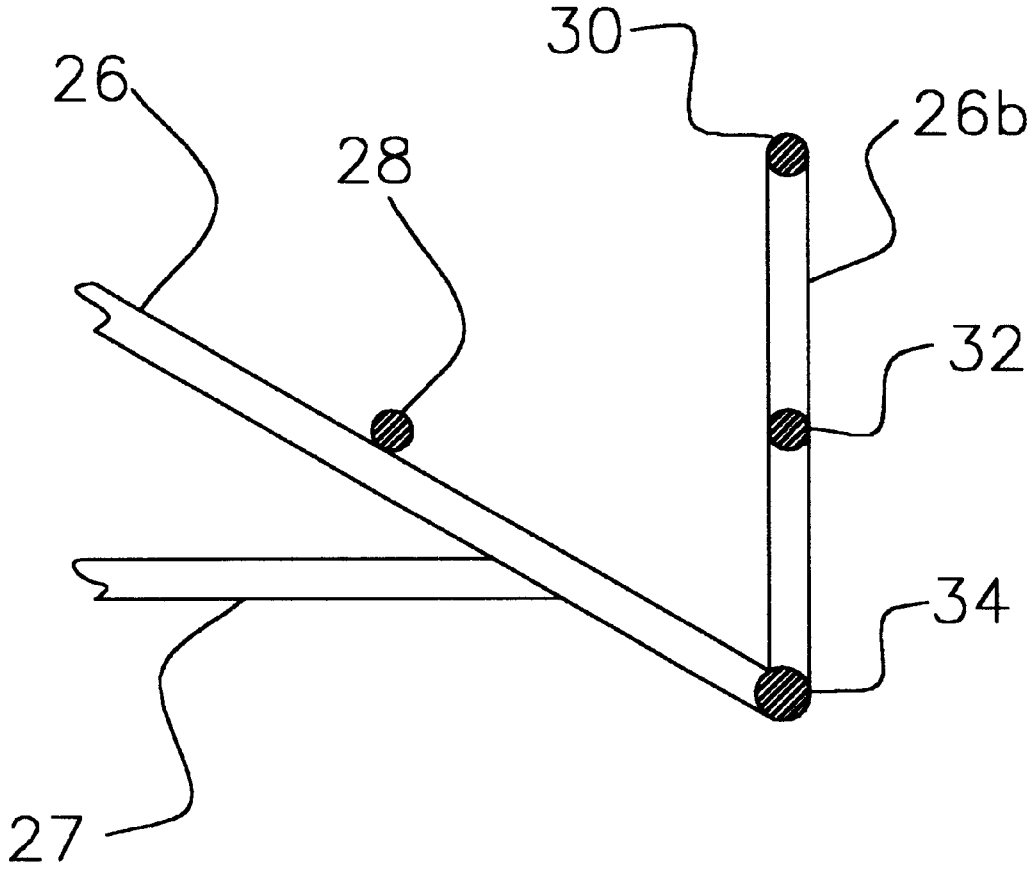
FIG. 8 is a sectional view of a portion of the shoe carousel device taken along the line 8—8 in FIG. 4.

Constructed in a conical form surrounding the hub member 24, each wire rack member 16 further comprises a plurality of wire spokes 26 radially disposed and connected at respective inner ends 26*a* of the spokes to the washer surface at the top of the hub member. The inner ends 26*a* of the radial spokes 26 are angularly spaced apart around the washer surface of hub member 24 and attached thereto, typically by welding, so that the plurality of radial spokes extend outwardly from the hub member in a substantially symmetrical pattern. From the respective points of attachment atop the hub member 24, each radial spoke 26 is further formed having a downwardly and outwardly inclined segment to provide each wire rack member with a conical framework. As best seen in FIG. 8, at the bottom of the inclined segment of each radial spoke 26 at a point determined by the intended slope and outer diameter of the wire rack member 16, an outer end segment 26*b* of each radial spoke 26 is deflected and formed upwardly at an acute angle to be disposed in a substantially vertical direction. As described in greater detail below, these vertically directed outer end segments 26*b* of the radial spokes 26 serve to provide a raised outer rim around the bottom of each wire rack member 16.

Figure 7:
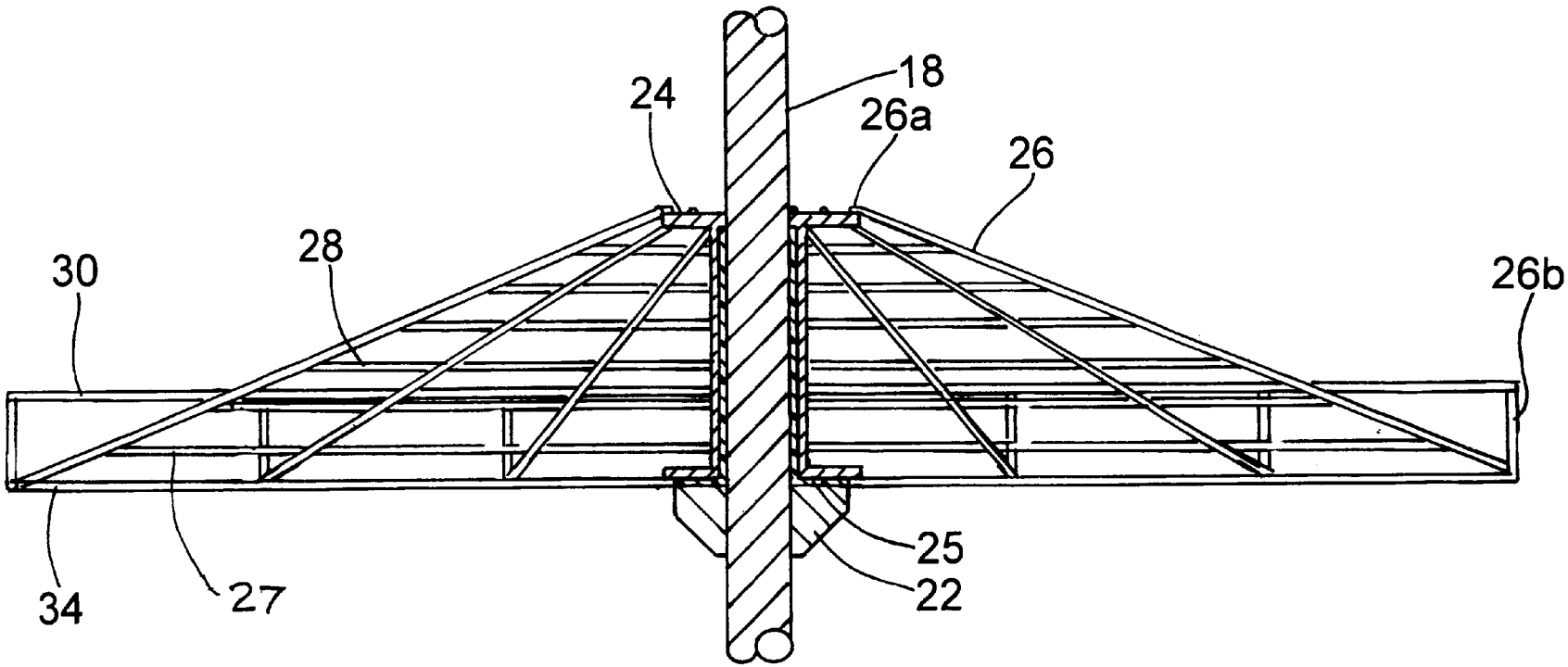
FIG. 7 is a sectional view of the shoe carousel device taken in elevation along the line 7—7 in FIG. 3.

Referring further to FIGS. 7 and 8 in conjunction with FIGS. 1–4, a plurality of transverse wire braces 27 running horizontally beneath the radial spokes 26 are connected between lower points on the inclined segments of the spokes and the lower body of the hub member 24 to provide structural support to the conical framework of each wire rack member 16. The number of these transverse braces 27 typically corresponds to the number of radial spokes employed on the wire rack member 16. A series of concentric wire rings 28 having progressively increasing diameters are horizontally disposed over and upon the radial spokes 26 along the inclined segments thereof. Each of the wire rings 28 is attached to respective contact points along the top of the inclined segment of the radial spokes 26, typically by welding, to provide an inclined support surface for the shoes S completely around the wire rack member 16. The diameters and spacing of the wire rings 28 may vary on each wire rack member 16 depending on the overall size of the rack member and the shoes intended to be supported and carried thereon.

Around the perimeter of each wire rack member 16, outer wire rings 30, 32 and 34 having equal diameters are coaxially disposed and secured to the outer end segments 26*b* of the radial spokes 26 at respective top, bottom and intermediate levels on the vertically-directed outer ends to produce a vertical rim raised around the bottom of the wire rack members. Secured to the outer end segments 26*b* of radial spokes 26 by conventional welding techniques, the upper ring 30 is attached to the tops of the outer ends of the spokes completely around the wire rack member 16 while the lower ring 34 is attached to the bottom of the spokes at the respective points where the outer end segments are deflected upward. The vertical spacing of the respective upper and lower rings 30 and 34 is thus established by the length of the outer end segments 26*b* similarly disposed in elevation around the outer edge of the wire rack member 16. This spacing between the upper and lower rings 30 and 34, respectively, may be typically at least two inches to contain the high heel of a shoe S within the wire rack member 16 if placed upon the inclined support surface in a "toe-up" position, the reverse of that shown in FIGS. 3 and 4. Intermediate ring 32 is attached to the inner length of each outer end segment 26*b* of the radial spokes 26 at a level proximate to the bottom edge, typically in the range of ½ inch. This intermediate ring 32 is particularly employed and incorporated into the raised rim structure surrounding each wire rack member 16 to confine and contain the pointed toe of a shoe S within the wire rack member 16 when placed in the "toe-down" position as shown in FIGS. 3 and 4.

The composite structure of the wire rack member 16 described above, including the radial spokes 26, transverse braces 27, concentric ring 28 and outer rings 30, 32 and 34 all interconnected about hub member 24, is set horizontally upon central shaft 18 supported by stop sleeve 22 and is capable of turning freely in a level plane. As best seen in FIG. 7, a cylindrical grommet member 25 made from a plastic material that affords reduced surface friction, is fitted to the interior of the hub member 24 and further formed having a flat washer-like base that rests at the bottom of the hub member when fully engaged therein. The grommet member 25 is sized to fit axially over and slide freely upon the central shaft 18 with the washer-like base resting directly upon the top of stop sleeve 22 and able to turn thereon to enhance the rotation of the wire rack member 16. Each wire rack member 16 can thus be separately and independently rotated, as desired by the user, by simple manipulation of the structure. Alternative means for rotatable coupling of the wire rack member 16 to the central shaft 18 may include incorporation of a ball-bearing surface on either the top of the stop sleeve 22 or the bottom of the wire rack member, particularly on the base of either the hub member 24 or grommet member 25.

Therefore, it is apparent that the described invention provides an improved rotatable shoe rack that makes efficient use of storage space, such as closets and the like, and better handles a fully capacity and wider variety of footwear than those shoe rack constructions heretofore devised. The disclosed shoe carousel device of the present invention is lightweight and portable yet capable of storing and handling a large number of shoes with improved stability. In addition, the disclosed invention in its multi-level construction provides adjustable spacing and independent rotation of the separate wire rack members to afford greater viewability and accessibility to the shoes stored thereon. The disclosed invention further provides a stable and effective shoe carousel that is reasonably inexpensive to fabricate, and easy to assemble for use and operation.

Obviously, other embodiments and modifications of the present invention will readily come to those of ordinary skill in the art having the benefit of teachings presented in the foregoing description and drawings. Alternate embodiments of different shapes and sizes, as well as substitution of known materials or those materials which may be developed at a future time to perform the same function as the present described embodiment are therefore considered to be part of the present invention. For example, the central shaft 18 may consist of a number of segmented tube or rod members in measured lengths that may be interconnected to provide adjustable shaft lengths and thus varied height to the shoe carousel device 10 of the present invention. As further example, the shaft 18 may be made of sufficient length to extend completely between the floor surface 12 and the ceiling or other horizontal surface above the floor so that the shaft can be secured between both surfaces by conventional mounting means and stationed in a substantially vertical attitude without use of the base stand 20 being required. Accordingly, it is understood that this invention is not limited to the particular embodiment described, but rather is intended to cover modifications within the spirit and scope of the present invention as expressed in the appended claims.

What is claimed:

1. A carousel device for storing shoes, comprising:

a shaft member adapted to be erected in substantially vertical position; and a plurality of wire rack members each supported upon said shaft member and coupled thereto for independent rotation in substantially horizontal planes, said wire rack members each formed having a conical framework to support shoes in an inclined position thereon and a raised rim formed upwardly in a vertical direction around the perimeter of the conical framework to contain the shoes therein during rotation, each wire rack member further comprising:

a hub member;

a plurality of radial spoke members connected about said hub member, each radial spoke member having a downwardly inclined segment extending from said hub member and a substantially vertical upright segment formed at an acute angle relative to the downwardly inclined segment at an outer end thereof;

a plurality of transverse brace members connected between said hub member and respective ones of said radial spoke members in support of the downwardly inclined segments thereof;

a plurality of concentric ring members coaxially disposed in parallel and secured to said radial spoke members along the downwardly inclined segments thereof; and a plurality of outer ring members coaxially disposed in parallel and secured to the substantially vertical upright segments of said radial spoke members to provide the raised rim around the perimeter of the conical framework of said wire rack members.

2. A shoe carousel device according to claim 1, further comprising:

a plurality of sleeve members each movable along said shaft member and adapted to be secured thereto to support a respective one of said wire rack members upon said shaft member.

3. A shoe carousel device according to claim 2, further comprising:

a base stand adapted to hold said shaft member erected in the substantially vertical position.

4. A shoe carousel device according to claim 1, wherein said plurality of outer ring members comprise:

an upper ring member secured to a respective top of each substantially vertical upright segment of said radial spoke members; and a lower ring member secured to a respective bottom of each vertically upright segment.

5. A shoe carousel device according to claim 4, wherein said plurality of outer ring members further comprise:

an intermediate ring member secured to the substantially vertical segments between said upper and lower ring members.

6. A carousel device for storing articles, comprising:

a shaft adapted to be erected upon a floor surface substantially perpendicular thereto;

at least one wire rack member coaxially coupled to said shaft and supported at a level thereon for rotating about said shaft member in a plane substantially perpendicular thereto, said wire rack member being formed having a conically-shaped framework to support articles thereon and a raised rim formed upwardly in a substantially vertical direction around the perimeter of the conically-shaped framework to contain the articles therein during rotation, said wire rack member further comprising: a hub member; a plurality of radial spoke members each having a downwardly inclined segment extending from said hub member and an upright segment formed at an acute angle relative to the downwardly inclined segment at an outer end thereof; a plurality of transverse brace members connected between said hub member and respective ones of said radial spoke members in support of the downwardly inclined segments thereof; a plurality of concentric ring members coaxially disposed in parallel and secured to said radial spoke members along the downwardly inclined segments thereof; and a plurality of outer ring members coaxially disposed in parallel and secured to the upright segments of said radial spoke members to provide the raised rim around the perimeter of the conical framework of said wire rack member; and means for rotatably supporting said at least one wire rack member upon said shaft.

7. A carousel device according to claim 6, wherein said plurality of outer ring members comprise:

an upper ring member secured to uppermost ends of the upright segments of said radial spoke members; and a lower ring member secured to lower ends of the upright segments.

8. A carousel device according to claim 7, wherein said outer ring members further comprise:

an intermediate ring member secured to the vertically upright segments of said radial spoke members between the upper and lower ring members.

9. A carousel device according to claim 6, wherein said means for rotatably supporting said wire rack member comprises:

at least one sleeve member formed to coaxially engage said shaft and adapted to be secured thereon in position to support said wire rack member in rotation at the level thereof.

10. A carousel device according to claim 6, further comprising:

a base stand adapted to hold said shaft in erected position upon the floor surface.

11. In a rotary shoe support device of the carousel type having a central shaft mounted on a floor surface in a substantially vertical position, the improvement comprising:

a wire rack member intended to coaxially engage the shaft for rotation in a substantially horizontal plane, said wire rack member being formed to provide a conical frame for supporting shoes in an inclined position and a raised rim formed upwardly in a substantially vertical direction at a bottom of the conical frame around the perimeter thereof for containing the shoes during rotation, said wire rack member further comprising:

a hub member;

a plurality of radial spoke members connected about said hub member, each radial spoke member having a downwardly inclined segment extending from said hub member and an upright segment formed at an acute angle relative to the downwardly inclined segment at an outer end thereof;

a plurality of transverse brace members connected between said hub member and respective ones of said radial spoke members in support of the downwardly inclined segments thereof;

a series of concentric ring members having progressively increasing diameters positioned over and secured to said radial spoke members along the downwardly inclined segments thereof; and a plurality of outer ring members coaxially disposed in parallel and attached to the upright segments of said radial spoke members to provide the raised rim around said wire rack members.

12. The improved rotary shoe support device of claim 11, wherein said outer ring members comprise:

an upper ring member attached to uppermost ends of the upright segments of said radial spoke members;

a lower ring member attached to a bottom end of the upright segments; and an intermediate ring member attached to the upright segments of said radial spoke members between the upper and lower ring members.

* * * * *